US011499237B2

(12) United States Patent
Geick et al.

(10) Patent No.: US 11,499,237 B2
(45) Date of Patent: Nov. 15, 2022

(54) TWO-STAGE PRETREATMENT OF ALUMINUM, IN PARTICULAR ALUMINUM CASTING ALLOYS, COMPRISING PICKLE AND CONVERSION TREATMENT

(71) Applicant: Henkel AG & Co. KGaA, Duesseldorf (DE)

(72) Inventors: Volker Geick, Grevenbroich (DE); Kathrin Schaeuble, Duesseldorf (DE)

( * ) Notice: Subject to any disclaimer, the term of this patent is extended or adjusted under 35 U.S.C. 154(b) by 128 days.

(21) Appl. No.: 16/817,044

(22) Filed: Mar. 12, 2020

(65) Prior Publication Data

US 2020/0208273 A1 Jul. 2, 2020

Related U.S. Application Data

(63) Continuation of application No. PCT/EP2018/067027, filed on Jun. 26, 2018.

(30) Foreign Application Priority Data

Sep. 18, 2017 (EP) ..... 17191578

(51) Int. Cl.
*C23C 22/34* (2006.01)
*C23G 1/12* (2006.01)
*C23C 22/82* (2006.01)

(52) U.S. Cl.
CPC ..... *C23G 1/125* (2013.01); *C23C 22/34* (2013.01); *C23C 22/82* (2013.01)

(58) Field of Classification Search
CPC ..... C23C 22/34; C23C 22/82
See application file for complete search history.

(56) References Cited

U.S. PATENT DOCUMENTS

| | | | | |
|---|---|---|---|---|
| 4,136,073 | A * | 1/1979 | Muro | C09D 5/084 106/14.21 |
| 2009/0159158 | A1* | 6/2009 | Hsu | C23C 22/68 148/254 |
| 2015/0176138 | A1* | 6/2015 | Brouwer | C23C 22/73 148/254 |
| 2016/0251761 | A1* | 9/2016 | Diez | C23C 2/36 428/626 |
| 2017/0016119 | A1* | 1/2017 | Van de Cappelle | C23C 22/34 |

FOREIGN PATENT DOCUMENTS

| | | | | |
|---|---|---|---|---|
| CN | 101463475 | A | 6/2009 | |
| CN | 106232871 | A | 12/2016 | |
| WO | 9428193 | A1 | 12/1994 | |
| WO | 0068458 | A1 | 11/2000 | |
| WO | 2003097899 | A2 | 11/2003 | |
| WO | 2006072780 | A1 | 7/2006 | |
| WO | WO-2015150387 | A1 * | 10/2015 | C23C 22/34 |

OTHER PUBLICATIONS

International Search Report for International Patent Application No. PCT/EP2018/067027 dated Sep. 28, 2018.

* cited by examiner

*Primary Examiner* — Hai Y Zhang
(74) *Attorney, Agent, or Firm* — Mary K. Cameron

(57) ABSTRACT

The present invention relates to a method for the anti-corrosion treatment of components produced from aluminum, in particular casting parts such as vehicle rims, comprising a pretreatment stage and subsequent coating, wherein the pretreatment stage in turn includes a pickle on the basis of sulfuric acid aqueous solutions containing water-soluble compounds of the element Ti and at least one α-hydroxycarboxylic acid which is carried out upstream of an acidic conversion treatment on the basis of an acidic aqueous solution containing water-soluble compounds of the elements Zr and/or Ti.

20 Claims, No Drawings

TWO-STAGE PRETREATMENT OF ALUMINUM, IN PARTICULAR ALUMINUM CASTING ALLOYS, COMPRISING PICKLE AND CONVERSION TREATMENT

The present invention relates to a method for the anti-corrosion treatment of components produced from aluminum, in particular casting parts such as vehicle rims, comprising a pretreatment stage and subsequent coating. The pretreatment stage in turn includes a pickle on the basis of phosphate-free sulfuric acid aqueous solutions containing water-soluble compounds of the element Ti and at least one polybasic α-hydroxycarboxylic acid and a source of fluoride ions which is upstream of a conversion treatment on the basis of an acidic aqueous solution containing water-soluble compounds of the elements Zr and/or Ti.

The prior art discloses a large number of pretreatment methods of components produced from aluminum, in particular from aluminum casting, for imparting corrosion protection and as a coating primer, which methods are based on a plurality of successive wet-chemical method steps. Usually, the component is first subjected to a cleaning process, which contains a combination of surface-active and pickling substances both for removing superficial contaminants originating from upstream fabrication stages, for example mold release agents, as well as for forming a reproducible component surface, which is necessary for the application of a homogeneous adhesion-promoting conversion layer. Depending on the type of cleaning, additional intermediate method steps may be required in order to obtain a substrate surface optimally conditioned for the conversion layer formation. WO 2003/097899 A2 thus discloses a method for the conversion treatment of aluminum wheels, in which an additional wet-chemical step is carried out in the manner of a pickling process between alkaline cleaning and conversion layer formation based on an acidic composition, which wet-chemical step is used to remove alkaline residues and the oxide layer remaining after cleaning. Only the component cleaned and "pickled" in this way has an almost metal surface and is thus optimally conditioned for the subsequent conversion layer formation.

The international publication WO 00/68458 A1 also addresses the problem of achieving the most efficient method sequence possible for the anti-corrosion pretreatment of components produced from aluminum. This document discloses a three-stage method consisting of acid pickling, rinsing and acidic conversion treatment based on the elements Zr and/or Ti, in which the rinsing between the pickling and the conversion treatment preferably consists of several rinsing steps, within which the rinsing water is guided in a cascade-like manner counter to the transport direction of the component.

It is also known from WO 94/28193 A1 that preservation of the aluminum surface produced after the cleaning and acid pickling can be achieved for a subsequent permanent anti-corrosion pretreatment if the pickling already comprises passivating active components selected from water-soluble compounds of the elements Zr and/or Ti. In addition, polyhydroxycarboxylic acids, such as gluconic acid, or polymers based on acrylates or derivatized vinylphenols are optional as active components in the acid pickle. The passivation achieved according to WO 94/28193 A1 is intended to protect the surface against partial oxidation until the application of the permanent anti-corrosion pretreatment and to preserve the largely homogenous chemical condition of the aluminum surface. The semi-finished product treated in this way can be subjected to further component production such as chipless machining, welding or reshaping until the permanent corrosion protection is applied, without any risk of adverse effects on the permanent corrosion protection that is immediately subsequently applied.

Acid pickling not only involves removing the oxide layer, but usually also includes pickling the component produced from aluminum itself. This is frequently desirable and necessary in order to provide a homogeneous, reproducible metal surface for the subsequent anti-corrosive conversion coating. However, this leads to the problem of accumulation of aluminum salts in the acid pickle. The high aluminum load is responsible for the precipitation of sparingly soluble salts, in particular in the presence of passivating active components based on the elements Zr and/or Ti and contained in the acid pickle. In the continuous operation of a pretreatment stage, the precipitates lead to sludge formation and incrustations, which must be removed more frequently on moving parts of the coating system such as valves for spray application or transport racks. Thus, periodic maintenance of the system is required, which cannot be performed during operation of the system and usually requires the replacement of the entire bath volume, so that the bath life is also significantly reduced.

The problem addressed by the present invention is now to provide the operators of a coating system for components produced from aluminum and its alloys, in particular castings, with a pretreatment stage which builds on the established process sequence of an acid pickle followed by a chromium-free conversion treatment based on the elements Zr and/or Ti, where, in the continuous operation of such a system, the bath life and maintenance intervals are increased in comparison with the prior art and, ideally, it is not necessary to service the pretreatment stage of the coating system due to sludge formation. At the same time, however, it is indispensable that any measure which is suitable for avoiding sludge formation at the same time exerts no negative influence on the corrosion protection and coating adhesion of the components pretreated in such a coating system.

This problem is solved by a method for the anti-corrosion treatment of components produced from aluminum, comprising a pretreatment stage and subsequent coating, in which, in the pretreatment stage, the component is first brought into contact with an aqueous phosphate-free sulfuric acid pickling solution which has a pH of from 1 to 2.5, a free acid content of at least 5 points and contains at least one water-soluble compound of the element Ti, a source of fluoride ions and at least one polybasic α-hydroxycarboxylic acid, and is subsequently brought into contact with an aqueous conversion treatment solution which has a pH of from 1 to 3.5 and contains at least one water-soluble compound of the elements Zr and/or Ti.

The pH denotes the negative decadic logarithm of the activity of the hydronium ions. According to the invention, the pH is determined potentiometrically at 20° C. directly in the solution by means of pH-sensitive electrodes after two-point calibration with buffer solutions for the pH values of 4.01 and 7.01.

A compound is water-soluble if its solubility in deionized water ($\kappa<1\ \mu Scm^{-1}$) and at a temperature of 20° C. is at least 1 g/kg. All quantities in "g/kg" refer to the proportion of the relevant component per kilogram of the reference solution indicated in each case.

In the method according to the invention, excellent coating adhesion is achieved which, surprisingly, is based on the combination of the Ti and Zr coatings applied in the multistage method even in the absence of phosphates and with high tolerance to aluminum ions in the pickle. The absence of phosphates and high tolerance to aluminum ions in the pickle make it possible for the pretreatment stage to not produce precipitates, and therefore no sludge, in continuous operation. This requires the presence of the polybasic α-hydroxycarboxylic acid.

Polybasic α-hydroxycarboxylic acids according to the present invention have at least two carboxylic acid groups and at least one hydroxyl group in the α-position with respect to one of the carboxylic acid groups. In a preferred embodiment, the at least one polybasic α-hydroxycarboxylic acid is selected from those compounds in which each carboxyl group has a hydroxyl group in the α- or β-position, and which furthermore preferably have no more than 8 carbon atoms. Particularly preferred representatives of the polybasic α-hydroxycarboxylic acid are tartaric acid and/or citric acid, more particularly preferably citric acid.

For a sufficiently high tolerance to aluminum ions and furthermore good results in the conditioning of the aluminum surface for the coating application in the pretreatment stage, it is preferred in the method according to the invention that the proportion of polybasic α-hydroxycarboxylic acids in the pickling solution is at least 0.1 g/kg, particularly preferably at least 0.5 g/kg, very particularly preferably at least 1 g/kg. For economic reasons, proportions above ten grams per kilogram of the pickling solution are not expedient and in the pickling solution are usually neither necessary for the conditioning of the aluminum surface in the pretreatment stage nor for the stabilization of the dissolved compounds of the element Ti. Consequently, the proportion of polybasic α-hydroxycarboxylic acids in the pickling solution in a preferred method according to the invention is therefore not greater than 4 g/kg, particularly preferably not greater than 2 g/kg.

The positive effect of the water-soluble compounds of the element titanium contained in the pickle in the presence of the source of fluoride ions on the subordinate conversion treatment is usually already achieved with small amounts in the range of a few milligrams of Ti per kilogram of pickle. The proportion of water-soluble compounds of the element Ti in the pickling solution is preferably at least 0.04 g/kg, particularly preferably at least 0.1 g/kg. Above one gram of Ti per kilogram of pickling solution, no significant improvement in coating adhesion is obtained after the conversion treatment. In order to avoid precipitation and to increase the tolerance to aluminum ions, it is therefore also preferable if the pickling solution is preferably contains no more than 0.6 g/kg, particularly preferably no more than 0.3 g/kg, of water-soluble compounds of the element Ti in each case with respect to the element Ti.

Titanyl sulfate ($TiO(SO_4)$), titanyl nitrate ($TiO(NO_3)_2$) and/or hexafluorotitanic acid ($H_2TF_6$) and the salts thereof are well suited as water-soluble compounds of the element Ti and are therefore preferred representatives in the pickling solution of the method according to the invention; hexafluorotitanic acid and the salts thereof is particularly preferred.

A source of fluoride ions is required according to the invention for sufficient pickling of the component produced from aluminum, without which a reproducible, largely oxide-free surface cannot be adjusted and the positive effect of the water-soluble compounds of the element titanium contained in the pickle on the coating adhesion is not possible.

A source of fluoride ions within the meaning of the present invention is any water-soluble inorganic compound containing fluorine which releases at least 100 mg/kg of fluoride ions as a 0.1 wt. % aqueous solution after TISAB buffering with an aliquot amount of the buffer, determined potentiometrically at 20° C. by means of a fluoride ion-sensitive electrode according to DIN 38 405-D-4-1. An aliquot amount of the buffer results in a volume-based mixing ratio of buffer to aqueous solution containing the source of fluoride of 1:1. The TISAB ("total ionic strength adjustment buffer") is prepared by dissolving 58 g NaCl, 1 g sodium citrate and 50 ml glacial acetic acid in 500 ml deionized water ($\kappa<1\ \mu Scm^{-1}$), setting a pH of 5.3 using 5 N NaOH and filling to a total volume of 1000 ml, again with deionized water ($\kappa<1\ \mu Scm^{-1}$).

In the present case, it is preferred if the total fluoride content in the pickling solution is at least 0.02 g/kg, particularly preferably at least 0.05 g/kg, very particularly preferably at least 0.1 g/kg, calculated as F. The total fluoride content is determined in the context of the present invention by means of a fluoride ion-sensitive electrode according to DIN 38 405-D-4-1, as described above.

The proportion of free fluoride in the pickling solution is to be kept low for a moderate pickling rate of the aluminum material. In a preferred embodiment, the proportion of free fluoride is therefore less than 10 mg/kg, particularly preferably less than 5 mg/kg, in each case determined potentiostatically directly in the pickling solution at 20° C. by means of calibrated fluoride-sensitive electrodes.

Suitable sources of fluoride ions are, for example, ammonium bifluoride, sodium fluoride and/or complex fluorides, in particular hexafluorotitanic acid and the salts thereof. However, complex fluorides of the element Zr should preferably not be contained in the pickling solution since these are also likely to cause the surfaces of the component produced from aluminum to be coated and therefore compete with the conditioning of the aluminum surfaces achieved by the water-soluble compounds of the element Ti.

In a preferred embodiment of the method according to the invention, the pickling solution therefore contains a total of less than 0.02 g/kg, particularly preferably less than 0.01 g/kg, very particularly preferably less than 0.004 g/kg, of water-soluble compounds of the element Zr, calculated as Zr.

The pickling solution preferably has a pH below 2.0 in a method according to the invention. This consistently ensures that sufficient pickling can take place in the pretreatment stage.

In a preferred embodiment of the method according to the invention, the pickling solution has a free acid content of at least 6 points, so that a pickling removal is ensured which is largely independent of the type of aluminum material to be treated and which is sufficient for the subsequent conversion treatment, for example in the series treatment of individual components produced from different aluminum materials in each case or in the series treatment of individual components produced from a mix of different aluminum materials. Conversely, the free acid content in points should preferably not be greater than 10 in order to effect sufficient conditioning of the aluminum surfaces on the basis of the water-soluble compounds of element Ti contained in the pickling solution.

The free acid content in points is determined in the context of the present invention by diluting 10 ml of the pickling solution to 50 ml and titrating with 0.1 N sodium hydroxide solution to a pH of 3.6. The consumption of milliliters of sodium hydroxide solution indicates the point number.

In addition to setting a free acid content in the pickling solution as a control parameter for providing surfaces of components produced from aluminum that are optimally pickled in the method according to the invention, the presence of a certain buffer capacity or a certain acidity has proven to be a stable process control in a series treatment. For this purpose, the total acid content is of importance and, in the pickling solution of the method according to the invention, this is preferably at least 12 points, but preferably no more than 18 points. According to the invention, the total acid content is determined analogously to the free acid with the difference that titration is carried out up to a pH of 8.5.

With regard to the acid to be used in the pickling solution of the pretreatment stage of the method according to the invention for setting the acid content, it was determined that said acid should be sulfuric for a good pickling action. An aqueous pickling solution is sulfuric if it contains sulfuric acid in order to adjust the pH and the proportion of other acids having a $pKS_1$ value of less than 2.5 for the first deprotonation step is less than 1 g/kg, particularly preferably less than 0 5 g/kg, more particularly preferably less than 0.1 g/kg.

Furthermore, the pickling solution in the method according to the invention is phosphate-free in order to prevent the precipitation of sparingly soluble salts and the layer formation on the surfaces of the component produced from aluminum. An aqueous pickling solution is phosphate-free if it contains less than 0.5 g/kg, preferably less than 0.1 g/kg, particularly preferably less than 0.05 g/kg, of phosphates dissolved in water, calculated as $PO_4$.

In a preferred method according to the invention, the pickling solution additionally contains a surface-active organic compound, particularly preferably a non-ionic surfactant, the proportion of surface-active organic substances in the pickling solution preferably being at least 0.1 mmol/L. In this context, preference is generally given to non-ionic surfactants of which the HLB (hydrophilic-lipophilic balance) value is at least 8, particularly preferably at least 10, more particularly preferably at least 12, but is particularly preferably no more than 18, more particularly preferably no more than 16. The HLB value is used for the quantitative classification of non-ionic surfactants according to their internal molecular structure, the non-ionic surfactant being broken down into a lipophilic and a hydrophilic group. The HLB value may assume values of zero to 20 on the arbitrary scale and is calculated according to the present invention as follows:

$$HLB=20\cdot(1-M_L/M)$$

where $M_L$: molar mass of the lipophilic group of the non-ionic surfactant

M: molar mass of the non-ionic surfactant

Particularly suitable non-ionic surfactants are selected from alkoxylated alkyl alcohols, alkoxylated fatty amines and/or alkyl polyglycosides, particularly preferably from alkoxylated alkyl alcohols and/or alkoxylated fatty amines, more particularly preferably from alkoxylated alkyl alcohols. The alkoxylated alkyl alcohols and/or alkoxylated fatty amines are preferably end-capped, particularly preferably having an alkyl group which in turn preferably has no more than 8 carbon atoms, particularly preferably no more than 4 carbon atoms.

In the method according to the invention, it is advantageous for sufficient pickling and conditioning of the aluminum surfaces and therefore also preferable for the component to be brought into contact with the pickling solution for long enough to pickle at least 2 mg of aluminum per square meter of the surface of the component that has been brought into contact, and particularly preferably also for long enough to produce a coating layer of at least 4 mg of titanium per square meter on the surface of the component that has been brought into contact. In this context, the pickling solution is also preferably adjusted for compliance with pretreatment-typical treatment times such that, for an alloy according to EN AW-6014 (AlMg0.6SiO.6V) at 40° C. in an unstirred pickling solution of the method according to the invention, a pickling rate of at least 15 $mgm^{-2}s^{-1}$ based on the element aluminum results.

In the conversion treatment immediately following the pickle, a conversion layer based on the elements Zr and/or Ti is applied in the method according to the invention. For sufficient coating adhesion, it is preferred if, after the conversion treatment, a coating layer of at least 50 $\mu mol/m^2$, preferably at least 100 $\mu mol/m^2$, particularly preferably at least 200 $\mu mol/m^2$, but preferably no more than 500 $\mu mol/m^2$ is determined by means of X-ray fluorescence analysis (XRFA) based on the sum of the elements Zr and Ti, and the components produced from aluminum are therefore brought into contact with the conversion treatment solution for long enough to produce a corresponding coating layer. For this purpose, it is further preferred that in the conversion treatment solution of the method according to the invention at least 0.1 mmol/kg, particularly preferably at least 0.5 mmol/kg, of water-soluble compounds of the elements Zr and/or Ti, calculated as a corresponding amount of the elements Zr and/or Ti, are contained, although for economic reasons preferably no more than 5 mmol/kg, particularly preferably no more than 3 mmol/kg. Suitable representatives of water-soluble compounds are ammonium zirconium carbonate ($(NH_4)_2\ Zr(OH)_2(CO_3)_2$), titanyl sulfate ($TiO(SO_4)$), zirconium sulfate ($Zr(SO_4)_2$), titanium nitrate ($Ti(NO_3)_4$), zirconium nitrate ($Zr(NO_3)_4$), zirconyl nitrate ($ZrO(NO_3)_2$), titanyl nitrate ($TiO(NO_3)_2$), ammonium zirconium lactate ($NH_4Zr(C_3H_5O_3)_5$), zirconium perchlorate ($Zr(ClO_4)_4$), titanium perchlorate ($Ti(ClO_4)_4$), and/or hexafluorotitanic acid ($H_2TF_6$) or hexafluorozirconic acid ($H_2ZrF_6$) and the respective salts thereof.

In this context, for effective layer formation based on the elements Zr and/or Ti in the conversion treatment, it is further preferable if the molar ratio of the total content of water-soluble compounds of the elements Zr and Ti relative to the respective elements to the total fluoride content in the conversion treatment solution is at least 0.1, particularly preferably at least 0.4. It has surprisingly been found that the use of water-soluble compounds of the element Zr, in particular of hexafluorozirconium acid and the salts thereof, in the conversion treatment solution in combination with the pickling solution containing Ti achieves the best coating adhesion results and is therefore preferred in the method according to the invention.

In a preferred embodiment of the method according to the invention, the pH of the conversion treatment solution in the pretreatment stage is at least 1.8, particularly preferably at least 2.0.

For a sufficient conversion treatment in the pretreatment stage of the method according to the invention, the presence of water-soluble compounds of the element chromium is not necessary. In a further preferred embodiment of the method according to the invention, the conversion treatment solution therefore contains a total of less than 0.1 g/kg of water-soluble compounds of the element chromium, calculated as Cr. The addition of phosphate ions to the conversion treatment solution is not advantageous either, so that said solution is, analogously to the pickling solution, phosphate-free in the method according to the invention and therefore contains less than 0.5 g/kg, preferably less than 0.1 g/kg, particularly preferably less than 0, 05 g/kg, of phosphates dissolved in water, calculated as $PO_4$.

Components produced from aluminum which are treated according to the present invention for corrosion protection, are those of which the metal component consists of or is composed of aluminum and/or aluminum alloys, in particular aluminum casting alloys. An alloy is an aluminum alloy in that it consists of at least 50 at. % of the element Al. In the method according to the invention, suitable components produced from aluminum are, for example, selected from semi-finished products such as sheet metal, sheets, coils or wires or from complex three-dimensional production objects such as rims for the automotive sector. In turn, the components may be formed from strip material or sheets and/or joined together or produced by casting. In the context of the present invention, the treatment of components produced from cast aluminum alloys, for example AA 6014, in particular rims for the automotive sector is preferred.

A pretreatment stage within the meaning of the present invention is a method stage which is separate from the application of the coating and comprises the method steps of pickling and conversion treatment, which are carried out at different times, using liquid compositions in the form of the pickling solution and the conversion treatment solution, respectively, which solutions are each stored in system tanks independently of one another. In a preferred embodiment, the components produced from aluminum are pretreated in series in the pretreatment stage of the method according to the invention. Pretreatment in series is considered according to the invention to be when a plurality of components produced from aluminum are brought into contact with the pickling solution and the conversion treatment solution, each stored in a system tank, without a complete replacement with a new batch of the pickling and conversion treatment solutions stored in the system tanks of the pretreatment stage taking place after each pretreatment of a single component produced from aluminum.

The transition of the component from the pickle into the conversion treatment takes place "immediately". According to the invention, this means that the conversion treatment follows the pickle without an intermediate step of wetting of the component with another liquid composition which is neither a rinsing solution nor a conversion treatment solution within the meaning of the present invention; however, there is preferably at least one intermediate rinsing step based on one or more rinsing solutions. A "rinsing step" within the meaning of the present invention denotes a process which is intended solely to remove as far as possible, from the surface of the component, active components from an immediately preceding wet-chemical treatment step, which are dissolved in a wet film adhering to the component, by means of a rinsing solution, without replacing the active components to be removed with other active components. In this case, active components are compounds dissolved in water which are already consumed by merely bringing the metal surfaces of the component into contact with the rinsing liquid. For example, the rinsing fluid can be city water.

Moreover, in a preferred method according to the invention, there is no method step in the pretreatment stage between the pickling and the conversion treatment in which drying or removal of the aqueous liquid film adhering to the surface of the component is intended by the provision and use of technical means, in particular by supplying thermal energy or applying an airflow.

The components to be treated in the method according to the invention originate from an upstream production process, and therefore the surfaces of said components should first be freed from impurities, such as mold release aids, in order to ensure good pickling. In a preferred method according to the invention, before being brought into contact with the pickling solution, the component undergoes alkaline degreasing, particularly preferably by being brought into contact with an alkaline aqueous composition which has a pH of greater than 9, but preferably less than 12, and a free alkalinity of at least 3 points but preferably less than 6 points and which optionally contains surface-active compounds which are preferably selected from non-ionic surfactants.

In this context, it is further preferred that after the alkaline degreasing and before being brought into contact with the pickling solution, a rinsing step, but preferably not a drying step, takes place.

The application of the cleaning, pickling and conversion treatment solution stored in the respective system tanks of the pretreatment stage can be carried out by all methods known in the prior art, where immersion and spraying methods for bringing the components produced from aluminum into contact with these solutions are preferred; the spraying method is particularly preferred as the type of application.

According to the invention, the coating following the pretreatment stage comprises the application of a composition containing a chemically or physically hardening binder to form a cover layer on the pretreated component produced from aluminum, the cover layer that results from the coating having, in the dried or hardened state, a layer thickness of preferably at least one micrometer, particularly preferably of at least 10 μm, measured according to the wedge-cut method according to DIN 50986:1979-03.

Suitable coatings are autophoretic coatings, electrodeposition coatings, powder coatings and liquid coatings which can be applied by conventional means. With regard to the binders used, both coatings based on inorganic binders, such as silicate or lime, and coatings based on organic binders can be used according to the invention. According to the invention, the subsequent application of coatings based on organic binders, in particular those containing less than 10 wt. % of organic solvent constituents which have a boiling point below 150° C. at 1 bar, is particularly advantageous. In this context, therefore, powder coatings are preferred, in particular those having binders based on epoxy resins, carboxyl group- and hydroxyl group-containing polyester resins and/or acrylate resins, each having excellent coating adhesion to the components produced from aluminum and pretreated according to the invention.

The component produced from aluminum can, after the pretreatment and before the coating, be subjected to rinsing, which serves to remove a wet film of the conversion solution adhering to the surface before the coating is applied. Furthermore, it is usual and may therefore be preferred that the component is dried before the application of the coating. This is the case in particular when a powder coating is to be applied, for which a particularly good coating primer is provided in the method according to the invention and therefore there is a preference.

PRACTICAL EXAMPLES

The anti-corrosion effect of a method sequence according to the invention is described below with reference to the pretreatment of aluminum sheets (EN AW-6014) and, in addition, the tendency toward sludge formation in sulfuric acid pickling solutions of the pretreatment stage containing fluoro complexes of the element titanium and 1 g/kg of dissolved aluminum is investigated.

The method sequence for the treatment of aluminum sheets (EN AW-6014) involved the successive method steps I to IV, where each of the method steps I-III was followed by a rinsing step with deionized water ($\kappa<1\ \mu Scm^{-1}$) and, after the rinsing step following method step III, the sheets were dried in an air stream before the coating was carried out in step IV:

I. Cleaning:

30 g/L BONDERITE C-AK G 414 (Henkel AG & Co. KGaA) in city water Brought into contact by spraying for 160 seconds at 60° C. and 1 bar II. Pickle:

Sulfuric acid aqueous solution having a pH of 1.6, containing 4.4 g/kg $Al_2(SO_4)_3.14H_2O$ and in addition a. 0.5 g/kg $H_2TF_6$ b. 0.5 g/kg $H_2TF_6$/1.3 g/kg citric acid Brought into contact by spraying for 160 seconds at 50° C. and 1 bar III. Conversion Treatment 30 g/L BONDERITE M-NT 4595 R5 MU (Henkel AG & Co. KGaA) in deionized water ($\kappa<1\ \mu Scm^{-1}$) resulting in a treatment solution containing 100 mg/kg $H_2ZrF_6$, a pH of 2.8 having been set by means of $NH_4CO_3$ solution.

IV. Coating

Powder coating Freiotherm P01857B plus clear coating Freiotherm KO1853KRA999 (both Emil Frei GmbH & Co. KG): Application amount of the powder coating was approximately 90 g/m$^2$ and after baking for 10 minutes at 180° C. resulted in a dry film thickness of approximately 60 μm.

Application amount of the clear coating was approximately 50 g/m$^2$ and baking for 10 minutes at 150° C. resulted in a dry film thickness of approximately 20 μm.

TABLE 1

Corrosion values on aluminum sheets (EN AW-6014) after coating layer build-up

| | | CASS test[1] | | |
|---|---|---|---|---|
| No. | Method sequence | Disbonding at the scratch[2]/mm | Delamination at the scratch[2]/mm | Sludge[3] |
| 1 | I-IIa-III-IV | 0.2 | 0.2 | Yes |
| 2 | I-IIb-III-IV | 0.1 | 0.1 | No |

[1]determined after 240 hours in the CASS test according to DIN EN ISO 9227

[2]U/2 value

[3]visible sediment formation in a 3 L beaker having an outer diameter of 150 mm containing 2 liters of the pickling solution 24 hours after pickling solution has been applied (yes/no)

The results of Table 1 demonstrate, with reference to the overall low disbonding values, the advantage of a procedure in which the pickling solution contains fluoro complexes of the element Ti.

In addition to the very good anti-corrosion results in the CASS test, in particular in the presence of citric acid, sludge formation is effectively prevented in such pickling solutions by the addition of citric acid.

TABLE 2

Sludge formation in the pickling solution in the presence of different inhibitors

| Inhibitor | Sludge formation [1] |
|---|---|
| Polyacrylic acid | Yes |
| Xanthan gum | Yes |

TABLE 2-continued

Sludge formation in the pickling solution in the presence of different inhibitors

| Inhibitor | Sludge formation [1] |
|---|---|
| Maleic acid | Yes |
| Malonic acid | Yes |
| Succinic acid | Yes |
| Mandelic acid | Yes |
| Lactic acid | Yes |
| Citric acid | No |
| Tartaric acid | No |
| Gluconic acid | Yes |
| Methanesulfonic | Yes |
| Sulfamic acid | Yes |

[1] Formation of a sediment in a 3 L glass beaker having an outer diameter of 150 mm containing 2 liters of the pickling solution visible after 24 hours (yes/no)

The sludge-inhibiting effect of the polybasic α-hydroxycarboxylic acids is illustrated in Table 2, which assesses the sludge formation in a pickling solution according to the above method step II, but to which solution a total of 1 g/kg of aluminum ions in the form of aluminum sulphate is added. It is clear from this table that inhibition of sludge formation, i.e. of the precipitation of aluminum and titanium salts, is achieved in the presence of citric acid or tartaric acid.

What is claimed is:

1. A method for an anti-corrosion treatment of components produced from aluminum, comprising a pre-treatment stage and subsequent coating, wherein the pre-treatment stage comprises steps of: a) contacting an aluminum or aluminum alloy component with an aqueous phosphate-free sulfuric acid pickling solution which has a pH of from 1 to 2.5, a free acid content of at least 5 points and contains at least one water-soluble compound of the element Ti, a source of fluoride ions and at least one polybasic α-hydroxycarboxylic acid present in the pickling solution in an amount of at least 0.1 g/kg but does not exceed 4 g/kg; and subsequently b) contacting the aluminum or aluminum alloy component pickled in a) with an aqueous conversion treatment solution which has a pH of from 1 to 3.5 and contains at least one water-soluble compound of the elements Zr and/or Ti.

2. The method according to claim 1, wherein the at least one polybasic α-hydroxycarboxylic acid in the pickling solution is selected from citric acid and/or tartaric acid.

3. The method according to claim 2, wherein the at least one polybasic α-hydroxycarboxylic acid in the pickling solution is tartaric acid.

4. The method according to claim 1, wherein the water-soluble compounds of the element Ti are present in the pickling solution in an amount of at least 0.04 g/kg, but not exceeding 0.6 g/kg, in each case based on the element Ti.

5. The method according to claim 4, wherein the at least one water-soluble compound of the element Ti is present in the pickling solution in an amount of no more than 0.3 g/kg based on the amount of Ti.

6. The method according to claim 5, wherein the at least one water-soluble compound of the element Ti is present in the pickling solution in an amount of at least 0.1 g/kg based on the element Ti.

7. The method according to claim 6, wherein the ratio of Zr and Ti to total fluoride content in the conversion treatment solution is at least 0.4.

8. The method according to claim 1, wherein the pickling solution has a pH of less than 2.

9. The method according to claim 1, wherein the pickling solution has a free acid content of at least 6 points, but no more than 10.

10. The method according to claim 1, wherein the pickling solution has a total acid content of at least 12 points, but no more than 18 points.

11. The method according to claim 1, wherein the at least one water-soluble compound of the elements Zr and/or Ti in the conversion treatment solution is present in an amount of at least 0.1 mmol/kg, and does not exceed 5 mmol/kg, in each case calculated as corresponding amounts of the elements Zr and/or Ti.

12. The method according to claim 1, wherein the water-soluble compounds of the elements Zr and/or Ti are selected from water-soluble compounds of the element Zr, which are in turn selected from hexafluorozirconic acid and the salts thereof.

13. The method according to claim 1, wherein the aluminum or aluminum alloy component is brought into contact with the pickling solution for long enough to pickle at least 2 mg of aluminum per square meter from contacted surfaces of the component and to optionally produce a layer of at least 4 mg titanium per square meter on the contacted surfaces of the component.

14. The method according to claim 1, wherein before contacting with the pickling solution, the component undergoes alkaline degreasing, by contacting the component with an alkaline aqueous composition which has a pH of greater than 9 but less than 12 and a free alkalinity of at least 3 points but less than 6 points and which optionally contains surface-active compounds which are selected from non-ionic surfactants.

15. The method according to claim 14, wherein after the alkaline degreasing and before contact with the pickling solution, the aluminum or aluminum alloy component is subjected to a rinsing step, but not a drying step.

16. The method according to claim 1, wherein after contact with the pickling solution and before contact with the conversion treatment solution, the aluminum or aluminum alloy component is subjected to a rinsing step, but not a drying step.

17. The method according to claim 1, wherein after contact with the conversion treatment solution and before the subsequent coating, a rinsing step takes place, and immediately before the subsequent coating, a drying step also takes place.

18. The method according to claim 1, wherein the component is coated with a powder coating during the subsequent coating.

19. The method according to claim 1, wherein a ratio of Zr and Ti to total fluoride content in the conversion treatment solution is at least 0.1.

20. The method according to claim 1, wherein the at least at least one polybasic $\alpha$-hydroxycarboxylic acid is present in the pickling solution in an amount of at least 0.5 g/kg but does not exceed 2 g/kg.

* * * * *